US009874210B2

(12) United States Patent
Moetakef et al.

(10) Patent No.: US 9,874,210 B2
(45) Date of Patent: Jan. 23, 2018

(54) VANE OIL PUMP

(71) Applicant: Ford Global Technologies, LLC, Dearborn, MI (US)

(72) Inventors: Mohammad Ali Moetakef, West Bloomfield, MI (US); Minghui Chien, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 173 days.

(21) Appl. No.: 14/926,641

(22) Filed: Oct. 29, 2015

(65) Prior Publication Data

US 2017/0122315 A1 May 4, 2017

(51) Int. Cl.
*F04C 2/344* (2006.01)
*F04C 15/00* (2006.01)
*F01M 1/02* (2006.01)

(52) U.S. Cl.
CPC ..... *F04C 15/0049* (2013.01); *F01M 1/02* (2013.01); *F04C 2/3448* (2013.01); *F01M 2001/0238* (2013.01); *F04C 2210/206* (2013.01); *F04C 2240/10* (2013.01); *F04C 2240/20* (2013.01)

(58) Field of Classification Search
CPC ..... F04C 15/0049; F04C 29/0035; F04C 2/3448; F04C 2210/206; F04C 2240/10; F04C 2240/20; F01M 1/02; F01M 2001/0238
USPC ..... 418/78
See application file for complete search history.

(56) References Cited

U.S. PATENT DOCUMENTS 4,557,678 A * 12/1985 Nishimura ..... F04C 29/00 417/540
4,746,280 A 5/1988 Wystemp et al.
4,789,317 A 12/1988 Waser et al.
5,046,933 A * 9/1991 Haga ..... F04C 15/0049 418/133
7,566,211 B2 7/2009 Nishikata et al.

FOREIGN PATENT DOCUMENTS

CN 101614204 A * 12/2009 ..... F01C 21/0809
CN 202338487 U 7/2012
JP 2007270698 A 10/2007

* cited by examiner

*Primary Examiner* — Mark Laurenzi
*Assistant Examiner* — Anthony Ayala Delgado
(74) *Attorney, Agent, or Firm* — Brooks Kushman P.C.; Greg Brown

(57) ABSTRACT

A vane fluid pump for a vehicle component has a cam defining a continuous inner wall surrounding a cavity, and an inner rotor supported within the cam. The inner rotor has a cylindrical outer wall defining a series of slots equally spaced about the outer wall. A series of vanes is provided with each vane positioned within a respective slot of the inner rotor and extending outwardly to contact the continuous inner wall of the cam. Each vane provides a fluid barrier between adjacent pumping chambers formed between the cam and the inner rotor. A first vane of the series of vanes defines a passageway thereacross to fluidly connect adjacent pumping chambers. The passageway is configured to disrupt harmonics during operation to reduce pressure ripples and associated tonal noise. At least another vane is configured without any fluid passageways.

18 Claims, 4 Drawing Sheets

VANE OIL PUMP

TECHNICAL FIELD

Various embodiments relate to a vane oil pump for a powertrain component such as an internal combustion engine or a transmission in a vehicle.

BACKGROUND

An oil pump is used to circulate oil or lubricant through powertrain components such as an engine or a transmission in a vehicle. The oil pump is often provided as a vane pump. Vane pumps have a positive displacement characteristic and tight clearances between various components of the pump that result in the formation of pressure ripples or fluctuations of the fluid within the pump and the attached oil galleries during operation of the pump. The pressure ripples of the fluid generated by the pump may act as a source of excitation to powertrain components, for example, when the pump is mounted to the powertrain components. For example, the pump may be mounted to an engine block, a transmission housing, an oil pan or sump housing, a transmission bell housing, and the like, where the pressure ripples may cause tonal noise or whine from the engine or the transmission. This oil pump-induced powertrain whine or tonal noise is a common noise, vibration, and harshness (NVH) issue, and mitigation techniques may include countermeasures such as damping devices that are added to the powertrain to reduce noise induced by a conventional pump.

SUMMARY

In an embodiment, a vane fluid pump for a vehicle component is provided with a cam defining a continuous inner wall surrounding a cavity, and an inner rotor supported within the cam. The inner rotor has a cylindrical outer wall defining a series of slots equally spaced about the outer wall. A series of vanes is provided with each vane positioned within a respective slot of the inner rotor and extending outwardly to contact the continuous inner wall of the cam. Each vane provides a fluid barrier between adjacent pumping chambers formed between the cam and the inner rotor. A first vane of the series of vanes defines a passageway thereacross to fluidly connect adjacent pumping chambers. The passageway is configured to disrupt harmonics during operation to reduce pressure ripples and associated tonal noise.

In another embodiment, an inner rotor for a vane fluid pump is provided with a body having a series of slots spaced about a perimeter of the body and extending between first and second end faces. The inner rotor has a series of vanes, with each vane slidably received within a respective slot. One of the vanes defines a fluid passageway extending between an upstream face and a downstream face. Another of the vanes is independent of fluid passageways.

In yet another embodiment, a vane pump is provided with an inner rotor eccentrically supported within a cam in a pump housing, the rotor having an outer perimeter defining (n) axial slots. The pump has (n) vanes received by the (n) axial slots, respectively, with between one and (n−1) vanes each defining a passageway therethrough. The passageway is configured to fluidly connect adjacent pumping chambers to disrupt harmonics. The remaining vanes are configured without passageways to prevent fluid flow between adjacent pumping chambers.

DETAILED DESCRIPTION

Figure 1:
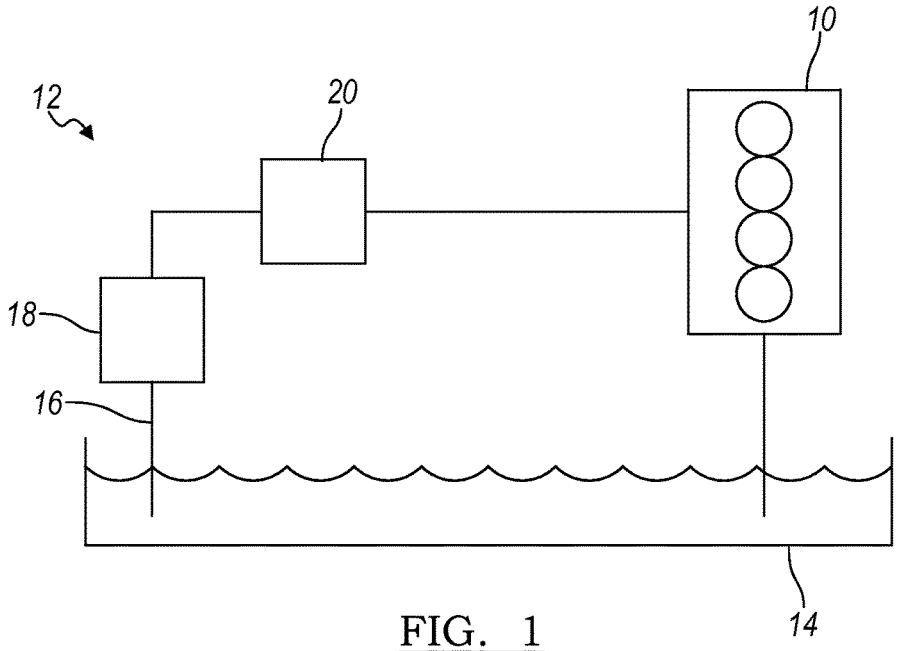
FIG. 1 illustrates a schematic of a lubrication system for an internal combustion engine in a vehicle according to an embodiment.

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

A vehicle component 10, such as an internal combustion engine or transmission in a vehicle, includes a lubrication system 12. The vehicle component 10 is described herein as an engine, although use of the system 12 with other vehicle components is contemplated. The lubrication system 12 provides a lubricant, commonly referred to as oil, to the engine during operation. The lubricant or oil may include petroleum-based and non-petroleum-synthesized chemical compounds, and may include various additives. The lubrication system 12 circulates oil and delivers the oil under pressure to the engine 10 to lubricate components in motion relative to one another, such as rotating bearings, moving pistons and engine camshaft. The lubrication system 12 may additionally provide cooling of the engine. The lubrication system 12 may also provide the oil to the engine for use as a hydraulic fluid to actuate various tappets, valves, and the like.

The lubrication system 12 has a sump 14 for the lubricant. The sump 14 may be a wet sump as shown, or may be a dry sump. The sump 14 acts as a reservoir for the oil. In one example, the sump 14 is provided as an oil pan connected to the engine and positioned below the crankshaft.

The lubrication system 12 has an intake 16 providing oil to an inlet of a pump 18. The intake 16 may include a strainer or filter and is in fluid contact with oil in the sump 14.

The pump 18 receives oil from the intake 16 and pressurizes and drives the oil such that it circulates through the system 12. The pump 18 is described in greater detail below with reference to FIGS. 2-4. In one example, the pump 18 is driven by a rotating component of the engine 10, such as a belt or mechanical gear train driven by the camshaft. In other examples, the pump 18 may be driven by another device, such as an electric motor.

The oil travels from the pump 18, through an oil filter 20, and to the vehicle component or engine 10. The oil travels through various passages within the engine 10 and then leaves or drains out of the engine 10 and into the sump 14.

The lubrication system 12 may also include an oil cooler or heat exchanger to reduce the temperature of the oil or lubricant in the system 12 via heat transfer to a cooling medium such as environmental air. The lubrication system 12 may also include additional components that are not shown including regulators, valves, pressure relief valves, bypasses, pressure and temperature sensors, additional heat exchangers, and the like.

The pump 18 has a positive displacement along with tight clearances between various components that may result in the formation of excessive pressure ripples within the pump and the attached oil galleries. The pressure ripples of the pump when mounted on a vehicle component such as an engine block or a transmission housing may act as an excitation source to the various components, such as an oil pan, transmission bell housing, etc.

Figure 2:
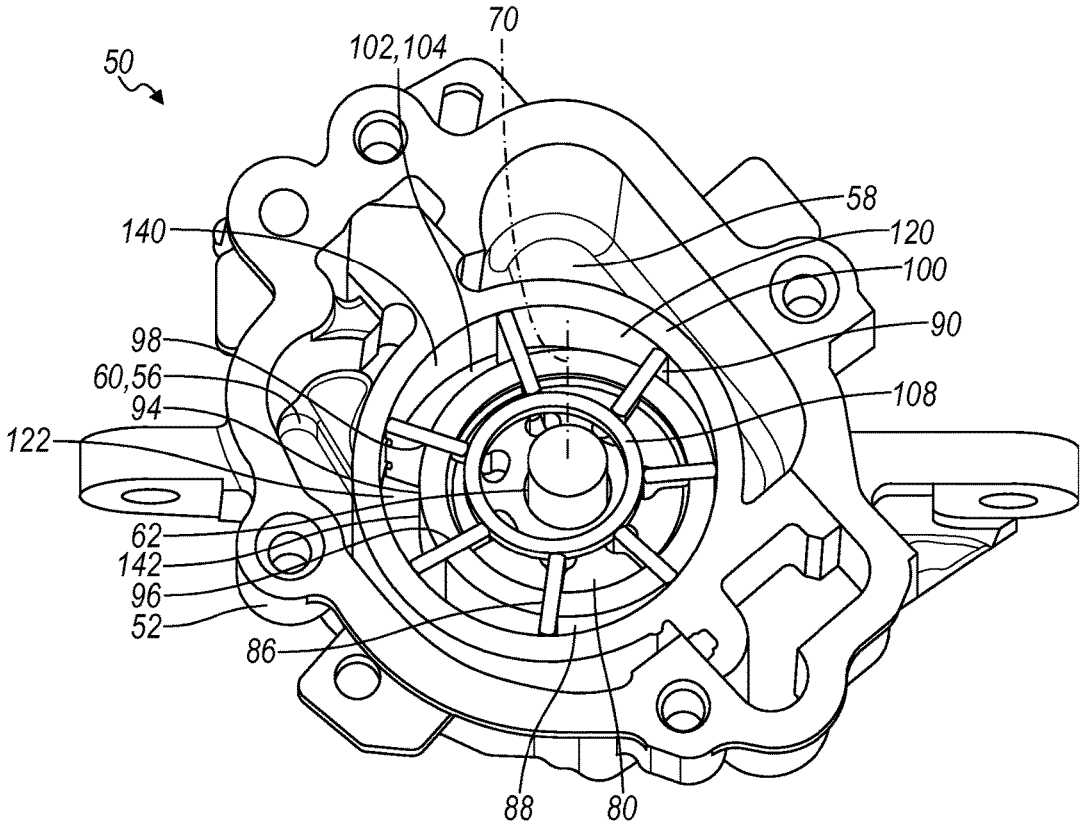
FIG. 2 illustrates a partial perspective view of a vane pump according to an embodiment.
Figure 3:
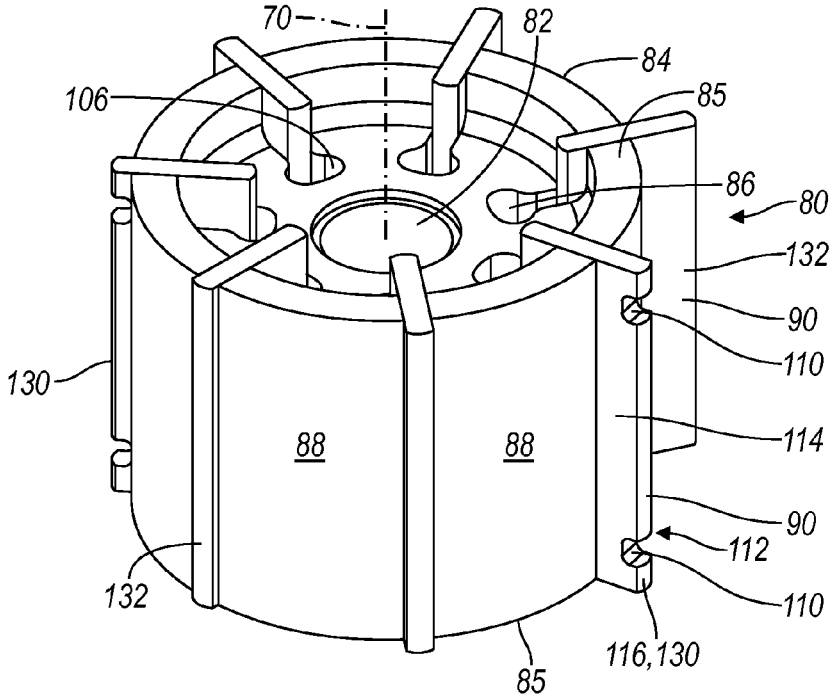
FIG. 3 illustrates a perspective view of an inner rotor for use with the vane pump of FIG. 2.
Figure 4:
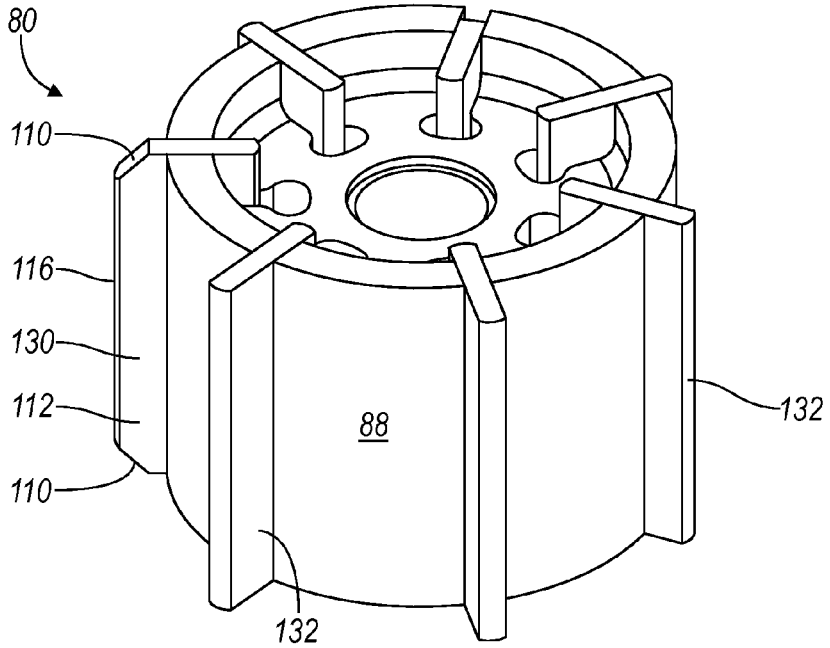
FIG. 4 illustrates a perspective view of another inner rotor for use with the vane pump of FIG. 2.

FIGS. 2-4 illustrate a pump 50 and various components thereof according to an embodiment. The pump 50 may be used in the lubrication system 12 as pump 18.

Referring to FIG. 2, the pump 50 is a vane pump, and is illustrated as being a sliding vane pump. In other examples according to the present disclosure the vane pump 50 may be other types of vane pumps including pendulum vane pumps, swinging vane pumps, and the like.

The pump 50 has a housing 52 and a cover. The housing 52 and the cover cooperate to form an internal chamber 56. The cover connects to the housing 52 to enclose the chamber 56. The cover may attach to the housing 52 using one or more fasteners, such as bolts, or the like. A seal, such as an O-ring or a gasket, may be provided to seal the chamber 56.

The pump 50 has a fluid inlet 58 and a fluid outlet 60. The fluid inlet 58 has an inlet port that is adapted to connect to a conduit such as intake 16 in fluid communication with a supply, such as an oil sump 14. The fluid inlet 58 is fluidly connected with the chamber 56 such that fluid within the inlet 58 flows into the chamber 56. The cover and/or the housing 52 may define portions of the inlet 58 region and inlet port. The inlet 58 may be shaped to control various fluid flow characteristics.

The pump 50 has a fluid outlet 60 or fluid discharge that has an outlet port that is adapted to connect to a conduit in fluid communication with an oil filter, a vehicle component such as an engine, etc. The fluid outlet 60 is fluidly connected with the chamber 56 such that fluid within the chamber 56 flows into the outlet 60. The cover and/or the housing 52 may define portions of the outlet 60 region and outlet port. The outlet 60 may be shaped to control various fluid flow characteristics. The inlet 58 and the outlet 60 are spaced apart from one another in the chamber 56, and in one example, may be generally opposed to one another.

The pump 50 has a pump shaft or driveshaft 62. The pump shaft 62 is driven to rotate components of the pump 50 and drive the fluid. In one example, the pump shaft 62 is driven by a mechanical coupling with an engine, such that the pump shaft rotates as an engine component such as a crankshaft rotates, and a gear ratio may be provided to provide a pump speed within a predetermined range. In one example, an end of the pump shaft 62 is splined or otherwise formed to mechanically connect with a rotating vehicle component to drive the pump 50.

The other end of the shaft 62 is supported for rotation within the cover and housing 52 of the pump 50. The cover and housing may define supports for the end of the shaft to rotate therein. The support may include a bushing, a bearing connection, or the like. The shaft rotates about a longitudinal axis 70 of the shaft.

The shaft 62 extends through the housing 52, and the housing 52 defines an opening for the shaft to pass through. The opening may include a sleeve or a seal to retain fluid within the pump and prevent or reduce leakage from the chamber 56. The opening may also include additional bushings or bearing assemblies supporting the shaft for rotation therein.

An inner rotor 80 or inner gear is connected to the pump shaft 62 for rotation therewith. The inner rotor 80 has an inner surface or wall 82 and an outer surface or wall 84. The inner wall 82 is formed to couple to the pump shaft for rotation therewith about the axis 70. In one example, the inner wall 82 is splined to mate with a corresponding splined section of the pump shaft, and in another example, is press fit onto the shaft 62.

The outer wall 84 provides an outer circumference or perimeter of the inner rotor 80. In one example, the outer wall is cylindrical or generally cylindrical. In other examples, the outer wall 84 is provided by another shape. The outer wall 84 extends between opposed end faces 85 of the inner rotor 80.

The inner rotor 80 has a series of slots 86 and a series of outer wall sections 88, or side wall sections. In the example shown, the inner rotor has seven slots and seven outer wall sections. The rotor 80 may have two or more slots and two or more corresponding outer wall sections in other examples. The slots 86 are spaced apart about the outer wall 84, and in one example, are equally spaced or spaced at equivalent angles about the inner rotor. The slots 86 define or provide the outer wall sections, as they divide the outer wall 84. Each outer wall section 88 is bounded by adjacent slots 86. The slots and outer wall sections alternate about a perimeter of the inner rotor. The outer walls sections 88 may lie about a perimeter of a common cylinder such that each outer wall section has a surface formed by a segment of a cylinder. For an inner rotor with equally spaced slots 86, each outer wall segment may have the same shape and size.

A series of vanes 90 is provided, with each vane positioned within a respective slot 86. Each slot 86 is sized to receive a respective vane. The vanes 90 are configured to slide within the slots 86. The vanes 90 and slots 86 may extend radially outward from the inner rotor 80 and axis 70, or may extend non-radially outwardly from the inner rotor 80.

Each outer wall section 88 extends between adjacent vanes 90. The inner rotor 80 rotates as the pump shaft 62 rotates. In the example shown, the inner rotor 80 rotates in a rotational direction, e.g. a counter-clockwise direction as shown in FIG. 2. Therefore, each outer wall section has an associated upstream edge adjacent to the upstream vane, and a downstream edge adjacent to the downstream vane to define a pumping chamber. For example, wall section 94 has an upstream edge 96 and a downstream edge 98.

The pump 50 has a cam 100 that has a continuous inner wall 102. The cam 100 is supported within the internal chamber 56 of the housing 52. The cam 100 may have various protrusions or locating features that cooperate with the housing 52 to position and fix the cam 100 in the pump 50. The inner wall 102 may be a cylindrical shape as shown. The inner wall 102 defines a cavity 104. The inner rotor 80 and the vanes 90 are arranged and supported within the cavity 104 of the cam 100.

The inner rotor 80 may be eccentrically supported within the cam 100 such that the axis 70 of the inner rotor is offset from an axis or the center of the cylindrical inner wall 102 and the cam 100.

The vanes 90 extend outwardly from the inner rotor 80, and a distal end of each vane 90 is adjacent to and in contact with the inner wall 102 of the cam during pump operation. The inner rotor, the cam, and the vanes cooperate to form a plurality of variable volume pumping chambers to pump fluid from a fluid inlet 56 of the pump to a fluid outlet 60 of the pump. The vanes act to divide the chamber 56 into pumping chambers, with each vane positioned between adjacent pumping chambers. As the inner rotor 80 rotates, the spacing between the outer wall 84 of the inner rotor and the cam inner wall 102 changes at various locations around the cam 100. The chamber 120 formed by the inner rotor, vanes, and cam near the inlet port 58 increases in volume, which draws fluid into the chamber from the inlet port. The chamber 122 near the outlet port 60 is decreasing in volume, which forces fluid from the chamber into the discharge port and out of the pump.

The vanes 90 may slide outwardly during pump operation based on centrifugal forces to contact the inner wall of the cam and seal the variable volume chambers. In other examples, a mechanism such as a spring, or a hydraulic fluid, may bias the vanes 90 outwardly to contact the cam inner wall.

The inner rotor 80 may include undervane passages 106 that act as back pressure chambers for pressure relief as the vane 90 retracts. The inner rotor 80 may also include a vane ring 108 supported on one of the end faces 85 of the inner rotor 80 that prevents retraction of the vanes when the pump 50 is stopped and centrifugal forces on the vanes are absent. The proximal end of the vanes 90 abuts the vane ring 108.

FIG. 3 illustrates an inner rotor for use with the pump 50. The inner rotor 80 has a series of vanes 90 that are spaced about the inner rotor, for example, at equal angles relative to one another. The inner rotor 80 has at least one fluid passageway 110 that is defined by a vane 90. The passageway 110 provides fluid communication between adjacent pumping chambers by providing a fluid pathway across or through the vane. Note that a conventional pump is provided with an inner rotor with unnotched vanes, or vanes that are designed and configured to prevent or block fluid flow across the vane, based on maintaining a maximum pumping efficiency and volume, where all of the vanes are independent of or do not have passageways.

The rotor 80 may have more than one passageway 110 as shown. The rotor 80 has (n) vanes, with (n−1) or fewer vanes with associated passageways, and 1 or more conventional or passageway-less vanes. In the example shown, the rotor 80 has four passageways 110, with two vanes each having two notches, and the remaining five vanes being solid. In another example, the rotor may have only one passageway 110 on only one vane.

The fluid passageway 110 extends between an upstream face 112 and a downstream face 114 of the vane 90. The passageway 110 may intersect the distal end face 116 of the vane 90 as shown, and be provided as a notch or slot. In other examples, the passageway 110 may be spaced apart or offset from the distal face 116, for example, as a hole or aperture. The passageway 110 provides a fluid pathway between the pumping chamber associated with the upstream face 112 of the vane and the pumping chamber associated with the downstream face 114 of the vane.

The passageways 110 as illustrated in FIG. 3 are each provided as a notch or a slot. In the example shown, each notch 110 has a rectangular cross-sectional shape with dimensions of 1-3 mm in width and 1-3 mm in height. For example, the fluid passageway may provide a fluid pathway that has a cross sectional area that is from five to twenty percent of the area of an exposed upstream or downstream face of the vane. Of course other dimensions and cross-sectional shapes may also be used, and may be based on the size of the pump and rotor, as well as the desired flow between adjacent pumping chambers.

FIG. 4 illustrates another variation of a rotor 80 for use with the pump 50 of FIG. 2. The inner rotor 80 has one or more fluid passageways 110 that are provided as chamfered edges at the distal corners or tips of the vane 90. The passageway 110 provides fluid communication between adjacent pumping chambers by providing a fluid path across the vane. The rotor 80 may have more than one passageway 110 as shown, or may be provided with only one fluid passageway. The rotor 80 has (n) vanes, with 1 to n−1 vanes that have associated passageways. In the example shown, the rotor 80 has two passageways 110, with one vane having two chamfers, and the remaining six vanes being solid.

The fluid passageway 110 extends between an upstream face 112 and a downstream face (opposed to face 112) of the vane 90. The passageway 110 may intersect the distal end face 116 of the vane 90 as shown, and be provided as a chamfer. The chamfers or passageways 110 are illustrated as having providing a fluid passageway with a triangular cross sectional shape. In other examples, the passageways 110 may have other shapes and be provided in a distal corner region of the vane.

In other examples, the passageway 110 has various shapes and sizes. For example, the passageway 110 may be a notch, slot, or channel across a vane and intersecting a distal end of the vane. The passageways may also be a chamfer or other shaped passage in a distal corner region of the vane. The passageway may be rectangular, curved, or another shape as is known in the art. The passageways 110 are illustrated as having a constant cross sectional area across the vane; however, in other examples, the passageway 110 may be tapered such that the cross sectional area increases or decreases between the upstream and downstream faces of the vane.

In other examples, the passageways 110 may be offset from the distal edge of the vane 90 such that they are spaced apart from the distal end and located on an intermediate region of the vane. In this configuration, the passageways 110 may be provided as apertures or holes extending through or across the vane. The passageway may be rectangular, circular, ovoid, elliptical, or another shape as is known in the art. The passageways may have a constant cross sectional area across the vane, or may be tapered such that the cross sectional area increases or decreases between the upstream and downstream faces of the vane.

In a further example, the passageways 110 may extend across the vane at an angle, such that the passageway 110 intersects the upstream face at a different radial position of the vane compared to the downstream face of the vane, and/or intersects the upstream face at a different position relative to the axis 70 compared to the downstream face.

Note that the inner rotor 80 is provided with at least one passageway 110 on a vane. At least one of the remaining vanes 132 is independent of passageways or is considered to be solid or continuous to prevent or block fluid flow between adjacent pumping chambers. The passageway 110 on a vane provides fluid communication and pressure relief between adjacent pumping chambers, while the continuous vanes 132 prevent fluid flow across the vane 132 and acts as a separator, divider or fluid barrier between adjacent pumping chambers.

The passageway 110 is configured to disrupt harmonics during operation of the pump 50 to reduce pressure ripples and associated tonal noise. By placing a passageway 110 such as a notch or a chamfer on some, but not all, of the vanes, the harmonics during pump operation are disrupted. The remaining vanes 132 are continuous or independent of passageways such that they present a fluid barrier to maintain overall pumping efficiency.

For an inner rotor 80 with more than one vane 130 having fluid passageways, as shown in FIG. 3, a continuous or solid vane 132 may be positioned between these vanes 130 such that no more than two adjacent pumping chambers are in fluid communication with one another. In other words, the vanes 130 may be arranged on the rotor 80 such that they are non-sequential or non-adjacent.

For vanes 130 with more than one passageway 110, the passageways 110 may be similarly sized, shaped and positioned on the vane; or may have different sizes, shapes and relative positions on the vane.

For inner rotors 80 with two or more vanes each having fluid passageways 110, the passageways 110 on the different vanes may be similarly sized, shaped and positioned on the vane; or may have different sizes, shapes, and relative positions on the vanes.

The location of the passageways 110 may be additionally based on the design and position of the outlet port, as the two combined will affect the formation of pressure ripples.

FIGS. 2-4 illustrate a vane pump with an inner rotor 80 having (n) vanes. The (n) vanes are shown as being equally spaced about the outer circumference of the rotor. The inner rotor 80 has (m) vanes that each define at least one fluid passageway thereacross to disrupt harmonics, where $1 \leq m < n$. The remaining (n-m) vanes are continuous and provide an unbroken fluid barrier.

Passageways 110, e.g. a notch at the edge and/or a chamfer at the top and/or bottom tips of the vanes, are provided on select vanes in the pump while other vanes are left as conventional solid vanes, and act to break the narrow-band harmonics of the oil pump into a broader-band frequency range resulting in reduced pressure ripples and oil pump tonal noise. These passageways 110 lower pressure spikes and additionally achieve more uniformly distributed pressure peaks in frequency leading to tonal noise reduction. The passageways 110 provide pressure relief for the pump 50 and act to reduce the tonal noise or whine. As the pump 50 operates, fluid within one of the variable volume chambers 140 is able to flow from the chamber 140 through passageway 110 and across the vane 130, an into an adjacent pumping chamber 142, as shown in FIG. 2.

Modeling and testing of the pump 50 having an inner rotor 80 as shown in FIG. 3 show improved pump operating characteristics compared to a pump having a conventional inner rotor. Modeling results are provided in FIGS. 5-6 and are based on a vane pump with seven vanes operating at 1970 rpm as determined using computational fluid dynamics (CFD) analysis. Note that in a conventional inner rotor and pump, no vanes have fluid passageways thereacross. The passageways 110 act to break down the harmonics caused by the rotation of the inner rotor 80 and act to reduce the pressure ripples and reduce the tonal noise or whine by providing pressure relief and limited fluid flow between adjacent pumping chambers.

Figure 5:
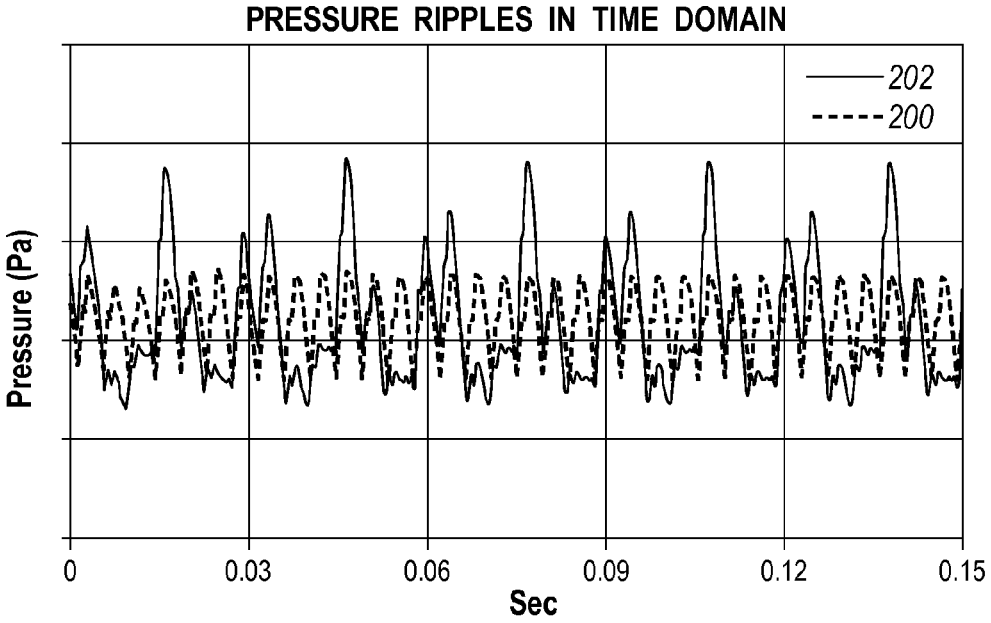
FIG. 5 illustrates pressure output from the pump of FIG. 2 compared to a pressure output from a pump with a conventional idler rotor.

A vane pump 50 having the rotor as described herein showed a reduction in pressure ripples or spikes during operation. For example, as shown in FIG. 5, a conventional pump while operating may provide fluid at the outlet of the pump with pressure fluctuations or pressure waves as shown by line 200 during a steady state operating condition. These pressure fluctuations are a difference between a maximum fluid pressure or spike and a minimum fluid pressure at the outlet. The pump 50 according to the present disclosure has a pressure fluctuation as shown by line 202 for the same steady state operating condition, and shows a significant decrease in pressure fluctuation.

Figure 6A:
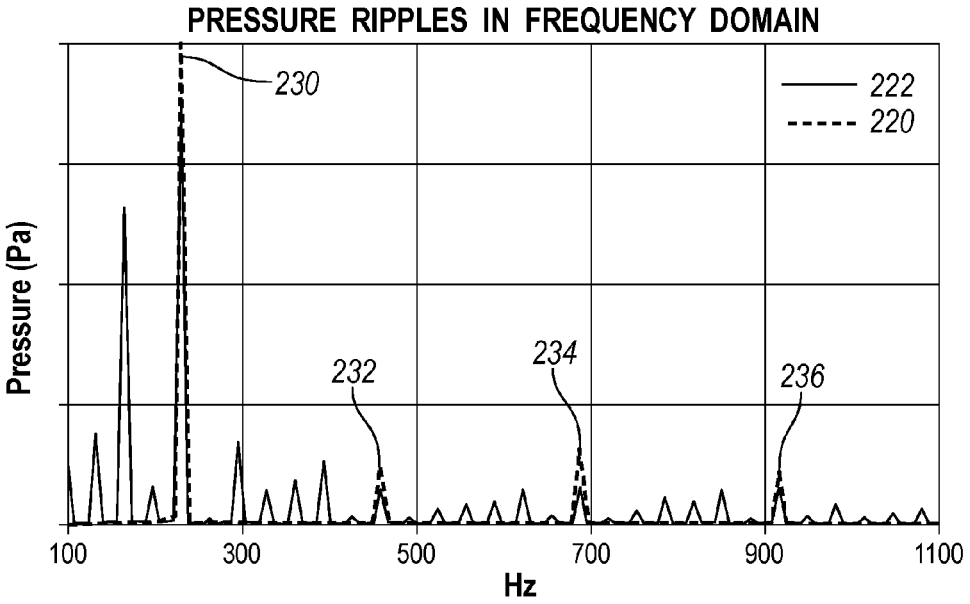
FIGS. 6A and 6B illustrate a frequency domain analysis for the pump of FIG. 2 with the inner rotor of FIG. 3 compared to a pressure output from a pump with a conventional inner rotor.
Figure 6B:
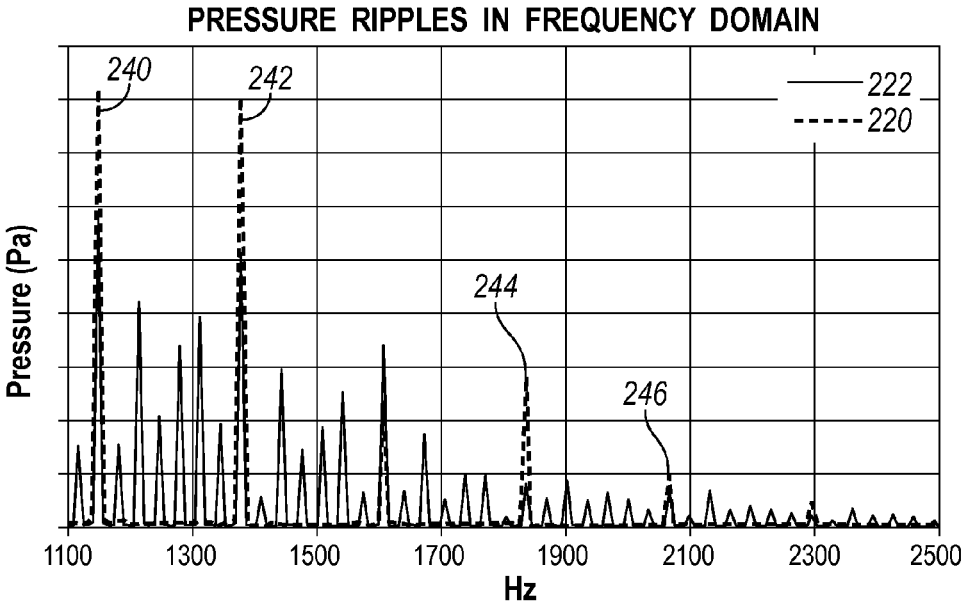

FIGS. 6A and 6B show the pressure ripples profiles in the frequency domain at the outlet of the pump 50 according to the present disclosure compared to a conventional pump. The fundamental frequency of the pump, i.e., 1st order, and the higher order harmonics are determined by the number of vanes. The inner rotor of the pumps has seven vanes, therefore, the harmonic orders of the pumps due to the pressure pulsations are multiples of 7 with the first order at 230 Hertz and the second order appearing at 460 Hertz.

From FIGS. 6A and 6B in the frequency domain, the lower pressure amplitudes for orders beyond the fundamental orders may be seen, and is a typical characteristic of vane pumps. The tonal noise is usually due to the higher orders of the pump and reduction in amplitude for the first order which corresponds to the pump pressure ripples usually is not enough to resolve the whine issue. For a vehicle component oil pump NVH assessment, pump pressure fluctuations at higher frequency orders are therefore considered, and may be decreased to reduce tonal noise.

An analysis across a frequency domain showed a significant decrease in pressure peaks for the various orders of the pump 50, with the pressure peaks greatly reduced for the higher orders as shown in FIGS. 6A and 6B with a conventional pump illustrated by line 220, and a pump 50 according to the present disclosure illustrated by line 222.

For example, in FIG. 6A, at frequency 230, the pump 50 has approximately a 15% reduction in pressure compared to the conventional pump, has approximately a 65% reduction at frequency 232, a 100% reduction at frequency 234, and a 35% reduction at frequency 236. In FIG. 6B, the pump 50 has approximately a 40% reduction in pressure at frequency 240 compared to the conventional pump, has approximately a 40% reduction at frequency 242, a 100% reduction at frequency 244, and approximately a 40% reduction at frequency 246. Note that pump 50 introduces side harmonics around the pump orders. The side peaks result in more uniformly distributed peaks in the frequency spectrum providing noise masking effect for tonal noise from the pump main orders.

The pump 50 according to the present disclosure additionally provides for decreased noise. For example, when the pump 50 according to the present disclosure is used with a powertrain for a vehicle the tonal noise from the powertrain is reduced. The tonal noise reduction using the pump 50 may provide for reduced NVH from the powertrain. Additionally, the powertrain or lubrication system may be simplified using a pump 50 according to the present disclosure. For example, the powertrain or lubrication system with a conventional pump may include noise reduction devices or features, and these features may be eliminated by switching to a pump according to the present disclosure. In one example, a conventional lubrication system includes a damping material such as a mastic located on the oil sump to reduce NVH caused by a conventional pump, and this damping material may be removed by switching to a pump 50 as described herein without an increase in tonal noise from the powertrain.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A vane fluid pump for a vehicle component comprising:

a cam defining a continuous inner wall surrounding a cavity;

an inner rotor supported within the cam, the inner rotor having a cylindrical outer wall defining a series of slots equally spaced about the outer wall; and a series of vanes, each vane positioned within a respective slot of the inner rotor and extending outwardly to contact the continuous inner wall of the cam, each vane providing a fluid barrier between adjacent pumping chambers formed between the cam and the inner rotor, wherein a first vane of the series of vanes defines a passageway thereacross and fluidly connecting adjacent pumping chambers, the passageway configured to disrupt harmonics during operation to reduce pressure ripples and associated tonal noise, and wherein a second vane of the series of vanes is independent of passageways such that the second vane prevents fluid flow between adjacent pumping chambers.

2. The pump of claim 1 wherein a third vane of the series of vanes defines a passageway thereacross to fluidly connect adjacent pumping chambers and disrupt harmonics during operation to reduce pressure ripples and associated tonal noise.

3. The pump of claim 2 wherein the second vane is positioned between the first and third vanes.

4. The pump of claim 1 wherein the first vane has an upstream face and a downstream face extending outwardly to a distal end; and wherein the passageway intersects the upstream face and the downstream face of the first vane.

5. The pump of claim 4 wherein the passageway intersects the distal end of the first vane.

6. The pump of claim 4 wherein the passageway is spaced apart from the distal end.

7. The pump of claim 1 wherein the passageway is a first passageway; and wherein the first vane further defines a second passageway thereacross and fluidly connecting adjacent pumping chambers.

8. The pump of claim 1 wherein only the first vane of the series of vanes defines the passageway such that the remaining vanes in the series of vanes are independent of passageways.

9. The pump of claim 1 wherein the passageway is a notch in a distal face of the first vane.

10. The pump of claim 1 wherein the passageway is a chamfer in a distal edge of the first vane.

11. The pump of claim 1 further comprising a drive shaft coupled for rotation with the inner rotor; and wherein the continuous inner wall of the cam is cylindrical; and wherein the inner rotor is eccentrically supported within the cam.

12. The pump of claim 1 wherein each vane is slidably received by the respective slot of the inner rotor.

13. The pump of claim 1 further comprising a vane ring positioned on an end face of the inner rotor;

wherein an inner end of each vane abuts the vane ring such that the vane ring is configured to prevent retraction of the vanes in the slots.

14. An inner rotor for a vane fluid pump comprising:

a body having a series of slots spaced about a body perimeter and extending between first and second end faces; and a series of vanes, each vane slidably received within a respective slot, one of the vanes defining a fluid passageway intersecting a distal face and extending between an upstream face and a downstream face, and another of the vanes being independent of fluid passageways.

15. The inner rotor of claim 14 wherein the another of the vanes has a continuous planar distal face.

16. A vane pump comprising:

an inner rotor eccentrically supported within a cam in a pump housing, the rotor having an outer perimeter defining (n) axial slots; and (n) vanes received by the (n) axial slots, respectively, between one and (n−1) vanes each defining a passageway therethrough, the passageway configured to fluidly connect adjacent pumping chambers to disrupt harmonics, the remaining vanes being without passageways to prevent fluid flow between adjacent pumping chambers.

17. The pump of claim 16 wherein between one and (n)/2 vanes each define a passageway, the remaining vanes being without passageways.

18. The pump of claim 17 wherein vanes without passageways are positioned between vanes defining passageways such that no more than two consecutive pumping chambers are in fluid communication with one another.

* * * * *